US010561282B2

(12) United States Patent
Miedzius

(10) Patent No.: US 10,561,282 B2
(45) Date of Patent: Feb. 18, 2020

(54) LIGATURE-RESISTANT DISPENSER

(71) Applicant: Speakman Company, New Castle, DE (US)

(72) Inventor: Christopher G. Miedzius, Newark, DE (US)

(73) Assignee: Speakman Company, New Castle, DE (US)

( * ) Notice: Subject to any disclaimer, the term of this patent is extended or adjusted under 35 U.S.C. 154(b) by 0 days.

(21) Appl. No.: 15/851,026

(22) Filed: Dec. 21, 2017

(65) Prior Publication Data

US 2019/0191934 A1 Jun. 27, 2019

(51) Int. Cl.
*A47K 5/12* (2006.01)

(52) U.S. Cl.
CPC ..... *A47K 5/1207* (2013.01); *A47K 2201/02* (2013.01)

(58) Field of Classification Search
CPC ..... A47K 5/1207; A47K 5/14; A47K 5/1202; A47K 5/1217; A47K 5/12; A47K 2201/02; B05B 11/3001; B05B 11/3087
USPC ..... 222/181.3, 325, 214, 105, 181.2
See application file for complete search history.

(56) References Cited

U.S. PATENT DOCUMENTS 4,036,406 A 7/1977 Jespersen et al.
4,673,109 A * 6/1987 Cassia ..... A47K 5/1209 222/153.03
4,961,508 A * 10/1990 Weimer ..... B67D 1/0001 222/183
4,978,036 A * 12/1990 Burd ..... A47K 5/1208 222/181.2
5,421,489 A * 6/1995 Holzner, Sr. ..... A47K 5/1208 222/181.2
5,431,309 A 6/1995 Ophardt
5,445,288 A * 8/1995 Banks ..... B05B 7/0025 222/95
5,465,877 A * 11/1995 Bell ..... A47K 5/12 222/181.2
6,347,724 B1 * 2/2002 Chen ..... B67D 1/108 222/1
6,516,976 B2 2/2003 Lewis et al.
6,533,145 B2 3/2003 Lewis et al.
6,701,573 B1 3/2004 Ciavarella et al.
7,066,356 B2 6/2006 Schuman et al.
7,798,370 B2 9/2010 Ciavarella et al.
7,798,371 B2 * 9/2010 Ophardt ..... A47K 5/1207 222/181.3
7,874,463 B2 1/2011 Ciavarella
7,950,548 B2 5/2011 Ciavarella et al.
8,047,404 B2 11/2011 Quinlan et al.
8,091,738 B2 1/2012 Ciaverella
8,348,101 B2 1/2013 Ciavarella et al.
8,387,830 B2 3/2013 Proper et al.
8,387,832 B2 3/2013 Zlatic
(Continued)

*Primary Examiner* — Charles Cheyney
(74) *Attorney, Agent, or Firm* — Potter Anderson and Corroon LLP

(57) ABSTRACT

Dispensers with anti-ligature safety features are disclosed herein. An anti-ligature dispenser may include a back mounting plate for mounting to a surface and a front housing cover with contoured and curved features that are substantially devoid of ligature anchoring points. Dispensing systems that allow for mechanically efficient actuation without providing gaps for ligature anchoring are also disclosed.

17 Claims, 8 Drawing Sheets

(56) References Cited

U.S. PATENT DOCUMENTS

| | | | | |
|---|---|---|---|---|
| 8,485,395 | B2 | 7/2013 | Ciavarella et al. | |
| 8,499,981 | B2 | 8/2013 | Quinlan et al. | |
| 8,534,504 | B2 | 9/2013 | Archer | |
| 8,561,847 | B2 | 10/2013 | Rosenkranz et al. | |
| 8,591,207 | B2 | 11/2013 | Ciavarella | |
| 8,783,520 | B2 * | 7/2014 | Hagleitner | A47K 5/1208 222/181.1 |
| 8,827,117 | B2 * | 9/2014 | Ho | A47K 5/1207 222/181.3 |
| 8,844,769 | B2 | 9/2014 | Rosenkranz et al. | |
| 8,851,331 | B2 * | 10/2014 | Pelkey | A47K 5/1202 222/181.3 |
| 8,905,265 | B2 * | 12/2014 | Muderlak | A47K 5/1207 222/38 |
| 8,991,655 | B2 | 3/2015 | Pelkey | |
| 9,027,797 | B2 | 5/2015 | Mann et al. | |
| 9,072,411 | B2 | 7/2015 | Corney | |
| 9,072,412 | B2 | 7/2015 | Ciavarella et al. | |
| 9,204,765 | B2 | 12/2015 | McNulty et al. | |
| 9,340,337 | B2 | 5/2016 | Pelkey et al. | |
| 9,408,502 | B2 | 8/2016 | Pelkey | |
| 9,561,517 | B2 | 2/2017 | Wertheim et al. | |
| 9,585,528 | B2 | 3/2017 | Khamphilapanyo et al. | |
| 9,611,839 | B2 | 4/2017 | McNulty et al. | |
| 9,616,445 | B2 | 4/2017 | Ciavarella et al. | |
| 9,687,121 | B2 | 6/2017 | Ciavarella et al. | |
| 9,687,122 | B2 | 6/2017 | Harris | |
| 9,730,557 | B2 | 8/2017 | Rospierski | |
| 9,738,435 | B2 | 8/2017 | Wegelin et al. | |
| 10,194,774 | B2 * | 2/2019 | Buell | A47K 5/1217 |

* cited by examiner

LIGATURE-RESISTANT DISPENSER

FIELD

The present invention is generally directed to dispensers that dispense a consumable product, such as soap, lotion, antiseptic, and the like. Specifically, the present invention is directed to surface mounted dispensers with anti-ligature features for the prevention of suicide attempts.

BACKGROUND

In environments with high suicide rates, such as medical facilities, prisons, detention centers, and mental health facilities, various structures within a room of the facility could be used as attachment or anchor points in suicide attempts. These anchor points can be used as attachment points for ligatures (e.g., rope, sheets, fabric, string, and the like) where the ligature is used by an individual to commit suicide by strangulation. Furthermore, an individual need not be fully suspended to commit suicide by hanging. Indeed, death by hanging or strangulation can occur while a person is partially suspended or in a kneeling, lying down, or seated position.

To prevent this from happening, rooms and fixtures may be designed to remove or minimize fixtures with such anchor points. Ligature anchoring points may be doors, grab bars, handles, towel bars, ceiling fans, door knobs and the like. Ligature anchoring points may also be dispensers, such as towel, liquid, or foam soap dispensers. Existing dispensers typically have a general box shape, which can allow for ligature anchoring to the top or to corners. Moreover, many dispensers are made from plastic materials that can easily be cracked or distorted allowing easier access to edges or corners from which to anchor a ligature.

In addition, wall-mounted dispensers can have a gap between the mounting surface and the dispenser, or are made from materials that can be bent or pulled from the mounting surface to create gaps for ligature anchoring. U.S. Pat. No. 9,585,528 discloses an anti-ligature system that includes sharp fixtures positioned to cut any ligature positioned between the dispenser and the mounting surface. However, skilled artisans will appreciate that significant damage to an individual may still occur even in the short amount of time that it takes for a ligature to be severed by these fixtures. Furthermore, these fixtures potentially become exposed sharp edges that present additional hazards.

Additional gaps or ligature anchor points can be created by the actuation system of existing dispensers. A typical dispenser utilizing manual actuation may include a lever type system with an externally accessible push bar. Once the push bar is depressed, it creates a gap between the push bar and the dispenser housing that can be used as an anchor point for a ligature. Such lever mechanisms are disclosed in, e.g., U.S. Pat. Nos. 8,991,655 and 6,701,573.

Therefore, there remains a need in the art for dispensers with improved anti-ligature safety features without sacrificing significant mechanical efficiency.

SUMMARY

In light of the foregoing, it is a first aspect of the present invention to provide an anti-ligature dispenser mountable to a surface comprising a back mounting plate having a vertical axis and adapted to be mounted to a surface, wherein the back mounting plate comprises a dispensing platform substantially perpendicular to the vertical axis of the back mounting plate, and wherein the back mounting plate further comprises a perimeter flange that extends outwardly from the back mounting plate and a front housing cover having an underside, the front housing cover having a cover edge configured to abut the back mounting plate inside the perimeter flange thereby enclosing the back mounting plate when in a closed position and preventing access to the underside of the front housing cover. In this aspect, the dispensing platform comprises an inner surface and an outer surface, where the front housing cover comprises a contoured outer surface substantially devoid of ligature anchoring points, and where the front housing cover when in the closed position and the outer surface of the dispensing platform form a housing bottom underside that is substantially devoid of ligature anchoring points.

In other embodiments, the front housing cover is hingedly connected to said back mounting plate by at least one hinging mechanism, wherein the at least one hinging mechanism is disposed within the underside of the front housing cover. In yet other embodiments, the front housing cover comprises a material having a yield strength of at least about 100 MPa. In still other embodiments, the front housing cover is made from aluminum metal.

In an embodiment, the dispensing system is configured to dispense a discrete quantity of fluid from a container, wherein the dispensing system comprises a lever member having a pivot, a first lever section, and a second lever section, the pivot pivotally connected to the underside of the front housing cover so that the lever member is moveable between a first position and a second position upon application of an input force to the first lever section; an actuator movable between a rest position and a dispense position and configured to contact at least one actuator contact point on the second lever section of the lever member; and an activator member comprising an exterior portion and an interior portion, wherein the exterior portion comprises a contact surface accessible on an exterior side of the front housing cover, and wherein the interior portion is configured to contact the first lever section of the lever member at an activator contact point.

In another embodiment, the dispensing system includes a first lever distance and a second lever distance, wherein the first lever distance is from the pivot to the activator contact point and the second lever distance is from the pivot to the at least one actuator contact point, and wherein the first lever distance is greater than the second lever distance. Further, the activator member is configured to receive an application of an input force at an axis substantially perpendicular to the vertical axis of the back mounting plate and apply a first output force to the first lever section of the lever member. In response, the lever member pivots from the first position to the second position and applies a second output force to the actuator, and the actuator, in response to the second output force, moves from the rest position to the dispensing position along an axis that is substantially parallel to the vertical axis of the back mounting plate. In another embodiment, the first lever distance is 105% greater than the second lever distance.

In some embodiments, the actuator comprises a set of upwardly curving actuator arms, the distal end of each actuator arm comprising an actuator notch; wherein the lever member further comprises comprises a set of lever arms, each lever arm extending laterally from the second lever section, the distal end of each lever arm comprising an upwardly extending portion that is disposed within a corresponding actuator notch when the front housing cover is in the closed position. In other embodiments, the exterior portion of the activator member comprises tapered side walls that extend externally from the front housing cover to the contact surface, and wherein exterior portion and the contact surface of the activator member are substantially devoid of ligature anchoring points. In yet other embodiments, the actuator further comprises a first dispensing cylinder having a first outer edge and an opening for liquid flowthrough, wherein the opening has a diameter of at least about 1.9 cm. In still other embodiments, the dispensing platform comprises a second dispensing cylinder having outer sidewalls tapered to a second outer edge and having an opening for receiving the first dispensing cylinder of the actuator, wherein the first dispensing cylinder moves within the second dispensing cylinder upon movement of the actuator between the rest position and the dispensing position, and wherein the first outer edge moves less than or equal to 1.5 cm externally to the second outer edge when the actuator is in the rest position.

Further, the anti-ligature dispenser may also include a pump stabilizing member connected to the back mounting plate and at least partially disposed within the underside of the front housing cover when in the closed position, wherein the pump stabilizing member is configured to receive a liquid container comprising a pump, and wherein movement of the actuator to the dispensing position compresses the pump of the liquid container thereby dispensing fluid into the opening of the first dispensing cylinder.

In another aspect, a dispenser is provided comprising an interior enclosed by a housing and a dispensing system; the housing comprising a contoured front surface substantially devoid of ligature anchor points and the dispensing system disposed within the interior and configured to dispense a discrete quantity of fluid from a container. In such aspect, the dispensing system includes a lever member having a pivot, a first lever section, and a second lever section comprising a set of laterally extending lever arms, the pivot pivotally connected to the underside of the front housing cover so that the lever member is moveable between a first position and a second position upon application of an input force to the first lever section; an actuator movable between a rest position and a dispense position and comprising a set of actuator notches, each actuator notch configured to contact a lever arm of the lever member at an actuator contact point; and an activator member comprising an exterior portion and an interior portion, wherein the exterior portion comprises a contact surface accessible on an exterior side of the front surface of the housing, and wherein the interior portion is configured to contact the first lever section of the lever member at an activator contact point.

In some embodiments, the lever section further comprises a first lever distance measured from the pivot to the activator contact point and a second lever distance measured from the pivot to an actuator contact point. In such embodiments, the first lever distance is greater than the second lever distance. In addition, the activator member is configured to receive an application of an input force along a first axis and apply a first output force to the first lever section of the lever member, wherein the lever member, in response to the first output force, pivots from the first position to the second position and applies a second output force to the actuator, and wherein the actuator, in response to the second output force, moves from the rest position to the dispensing position along a second axis that is substantially perpendicular to the first axis. In other embodiments, the exterior portion of the activator member comprises tapered side walls that extend externally from the front surface of the housing to the contact surface, and wherein exterior portion and the contact surface of the activator member are substantially devoid of ligature anchoring points. In yet another embodiment, the activator member is a push button.

In an embodiment, the actuator further comprises a dispensing cylinder having an opening for liquid flowthrough, wherein the opening has a diameter between about 1.5 cm and about 2.5 cm and is configured for receiving a pump nozzle, wherein the actuator further comprises a clip receptacle configured for receiving a clip for attaching the pump nozzle to the actuator thereby preventing access to the interior of the housing.

In another aspect, provided herein is an anti-ligature dispenser mountable to a surface comprising a back mounting plate having a vertical axis and adapted to be mounted to a surface, wherein the back mounting plate comprises a dispensing platform substantially perpendicular to the vertical axis of the back mounting plate; a front housing cover having an underside, the front housing cover having a cover edge configured to abut the back mounting plate thereby enclosing the back mounting plate when in a closed position and preventing access to the underside of the front housing cover; and an actuator disposed within the underside of the front housing cover when in the closed position, the actuator moveable between a rest position and a dispense position, wherein the actuator further comprises a first dispensing cylinder having a first outer edge and an opening for liquid flowthrough. In this aspect, the dispensing platform comprises an outer surface and a second dispensing cylinder having outer sidewalls tapered to a second outer edge and having an opening for receiving the first dispensing cylinder, wherein the first dispensing cylinder moves within the second dispensing cylinder upon movement of the actuator, and wherein the first outer edge moves less than or equal to 1.5 cm externally to the second outer edge when the actuator is in the rest position; and wherein the front housing cover comprises a contoured outer surface substantially devoid of ligature anchoring points, and wherein the front housing cover when in the closed position and the outer surface of the dispensing platform form a housing bottom underside that is substantially devoid of ligature anchoring points.

In another embodiment, the anti-ligature dispenser also includes a lever member having a pivot, a first lever section, and a second lever section, the pivot pivotally connected to the underside of the front housing cover so that the lever member is moveable between a first position and a second position upon application of an input force to the first lever section, wherein the actuator is configured to provide at least one contact point with the second lever section of the lever member; an activator member comprising an exterior portion and an interior portion, wherein the exterior portion comprises a contact surface accessible on an exterior side of the front housing cover, and wherein the interior portion is configured to contact the first lever section of the lever member; and wherein the activator member is configured to receive an application of an input force along a first axis and apply a first output force to the first lever section of the lever member, wherein the lever member, in response to the first output force, pivots from the first position to the second position and applies a second output force to the actuator, and wherein the actuator, in response to the second output force, moves from the rest position to the dispensing position along a second axis that is substantially perpendicular to the first axis.

BRIEF DESCRIPTION OF THE DRAWINGS

These and other features and advantages of the present disclosure will become better understood with regard to the following description, appended claims, and accompanying drawings wherein:

FIG. 1A is a front perspective view of an exemplary anti-ligature dispenser.

FIG. 1B is a back view of an exemplary anti-ligature dispenser.

FIG. 1C is a side view of an exemplary anti-ligature dispenser.

FIG. 2A is a cross-sectional diagram of an exemplary anti-ligature dispenser.

DETAILED DESCRIPTION

The dispensers disclosed herein possess a unique and innovative design that confers increased safety features. Provided herein are anti-ligature dispensers with a contoured and resilient housing design that prevents attachment of ligatures that could be used to cause harm to individuals. Further, the instant disclosure describes an inventive dispenser system with a gap-free and contoured activator member that provides additional safety while maintaining the mechanical efficiency necessary to allow easy operation of the device. The anti-ligature dispensers disclosed herein may include additional safety features as will be described in more detail below.

Unless defined otherwise, all technical and scientific terms used herein have the same meaning as those commonly understood by one of ordinary skill in the art to which this invention belongs. Standard techniques are used unless otherwise specified. Although methods and materials similar or equivalent to those described herein can be used in the practice or testing of the present disclosure, suitable methods and materials are described below. The materials, methods and examples are illustrative only, and are not intended to be limiting. All publications, patents and other documents mentioned herein are incorporated by reference in their entirety.

As used herein, the singular forms "a," "an," and "the" include the plural referents unless the context clearly indicates otherwise.

The term "about" refers to the variation in the numerical value of a measurement, e.g., diameter, weight, length, volume, angle degrees, etc., due to typical error rates of the device used to obtain that measure. In one embodiment, the term "about" means within 5% of the reported numerical value, preferably, the term "about" means within 3% of the reported numerical value.

It is an aspect of this disclosure to provide an anti-ligature dispenser that is substantially devoid of ligature attachment or anchoring points when mounted to a surface, such as a wall or pillar. The term "substantially" means that the anti-ligature dispenser provided herein has an exterior surface that, when mounted to a surface, does not have any edges, corners, gaps, or other features that provide an attachment point for a ligature (e.g., rope, string, sheet, fabric, cord, and the like) supporting more than about 2 kg to about 5 kg of weight. For instance, the anti-ligature dispensers described herein may include a back mounting plate for mounting the dispenser to a surface wherein the contact between the dispenser and the mounting surface is substantially devoid of gaps for which a ligature could be attached or anchored. Further, the anti-ligature dispensers described herein may include a contoured, smooth and rounded front surface that is substantially devoid of ligature anchoring points.

Figure 1A:
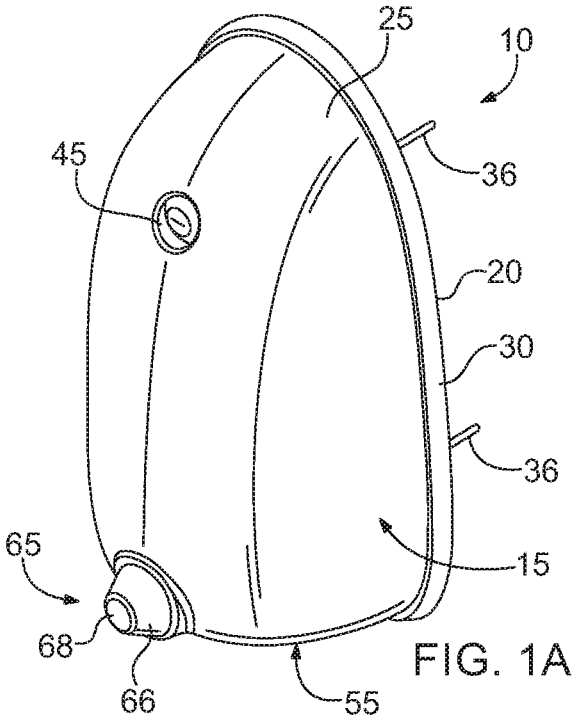
FIGS. 1A-C depict various views of an exemplary anti-ligature dispenser according to the concepts of the present disclosure.

Referring now to FIGS. 1-3 it can be seen that an anti-ligature dispenser is designated generally by the numeral 10. The dispenser 10 includes a dispenser housing 15 that encloses a material to be dispensed such as a solid or a liquid. In particular aspects, the material is a liquid, such as soap, lotion, sanitizer, and the like. The anti-ligature dispenser will have a dispensing system capable of dispensing a discrete amount of the solid or liquid. In some embodiments, the dispenser system dispenses solid or liquid in response to some type of sensor detection. In other embodiments, dispenser system dispenses solid or liquid in response to mechanical activation of the system, e.g., manual operation of a press button. The dispenser housing 15 may include a back mounting plate 20 which in most embodiments is substantially planar and capable of being mounted to a surface, such as a wall. A front housing cover 25 may be attached or connected to the back mounting plate 20. In some embodiments, the front housing cover 25 is sized to fully encapsulate the back mounting plate 20 when the dispenser is in the operational condition. In other words, no edges of the back mounting plate 20 are exposed when the front housing cover 25 is in a closed position. In other embodiments, the front housing cover 25 abuts the back mounting plate 20 such that there is no space between the front housing cover 25 and the back mounting plate 20 from which to attach or insert a ligature.

In particular embodiments, the back mounting plate 20 includes a perimeter flange 30 that extends outwardly from the back mounting plate 20. In such embodiments, the front housing cover 25 is sized such that the cover edge 28 (see FIG. 3A) of the front housing cover abuts the back mounting plate 20 and fits tightly inside the perimeter flange 30 thereby effectively eliminating gaps in which to attach a ligature. Moreover, the front housing cover 25 may be contoured to create a very smooth and sloping surface that does not have ledges, corners, edges, or gaps and, therefore, does not allow for attachment of ligatures. Since the dispenser will typically be configured for receiving a material container, such as a liquid container, within its interior, it is contemplated that the front housing cover 25 will have a general elongated dome or concave shape with sloped curves to a generally flat bottomside 55, from where material is dispensed (see, for example FIGS. 1A and 1C). Thus, when mounted to a surface, the front housing cover will be substantially devoid of ligature anchor points.

In particular embodiments, the housing 15 of the anti-ligature dispenser may be made wholly or partially from a material with high yield strength to resist deformation. For instance, the back mounting plate 20, the front housing cover 25, or both may be made from a strong plastic or metal material that is not easily cracked, dented, or otherwise distorted so as to allow access to the interior or enable attachment of a ligature. Further, the back mounting plate 20 may be made from a strong plastic or metal material that is not easily distorted and pulled from its mounting surface so as to create a gap between the mounting surface and the dispenser from which to attach or anchor a ligature. As one having ordinary skill in the art would understand, the term "yield strength" is defined as the stress at which a predetermined amount of permanent deformation to the material occurs. Suitable housing material may have a yield strength of at least about 100 MPa. In some embodiments, the yield strength should be at least about 130 MPa. In yet other embodiments, the yield strength is about 160 MPa or more. In other embodiments, the material may have a yield strength of at least about 275 MPa. In yet other embodiments, a suitable material will have a yield strength of about 100 MPa, 105 MPa, 110 MPa, 115 MPa, 120 MPa, 125 MPa, 130 MPa, 135 MPa, 140 MPa, 145 MPa, 150 MPa, 155 MPa, 160 MPa, 165 MPa, 170 MPa, 175 MPa, 180 MPa, 185 MPa, 190 MPa, 195 MPa, 200 MPa, 210 MPa, 220 MPa, 230 MPa, 240 MPa, 250 MPa, 260 MPa, 270 MPa, 280 MPa, 290 MPa, 300 MPa, or more. The housing of the dispenser may be made from hard plastic, glass filled plastic, or metal, using art-standard molding or die cast techniques. Exemplary metals include stainless steel, zinc, and aluminum. In some embodiments, the anti-ligature dispenser is made from aluminum. Thus, the anti-ligature dispenser housing provided herein is not easily cracked, distorted, or dented therefore providing for a housing surface that is substantially devoid of ligature anchoring points when in a closed position (i.e., operational configuration) and mounted to a surface.

Figure 1B:
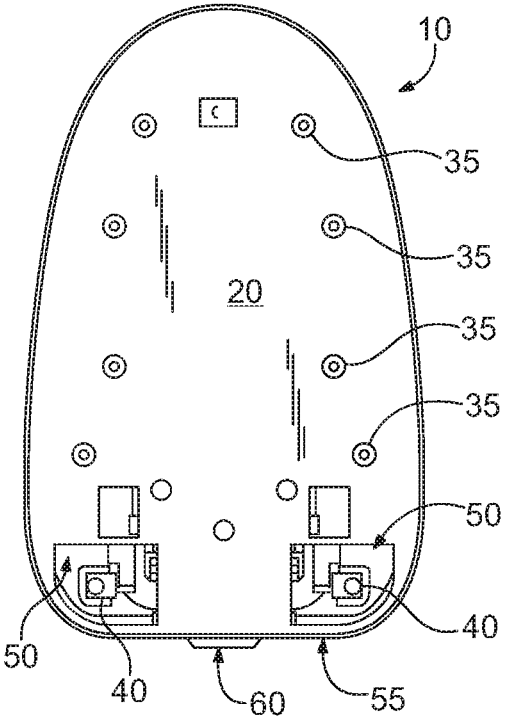
Figure 1C:
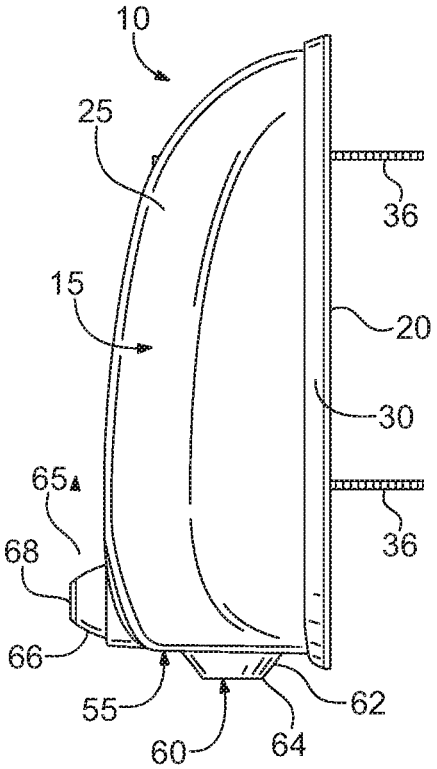

As depicted in FIG. 1B, the anti-ligature dispenser may contain a plurality of mounting holes 35 in the back mounting plate 20. The back mounting plate 20 can then be secured to a surface (e.g., wall) with, e.g., mounting screws 36. The front housing cover 25 may be snap-fit or otherwise attached to the back mounting plate 20 by any suitable means. In a particular embodiment, front housing cover 25 is attached to the back mounting plate by one or more hinge attachments 40. For instance, the hinge attachment 40 may be a set of pins 42 integral to the back mounting plate 20 and attached to metal brackets 44 that that are fastened to the underside of the front housing cover 25 (see FIGS. 1B, 3A, and 3B). In such embodiments, the interior of the dispenser housing may be accessed by pivoting the front housing cover 25 at the hinge attachments 40. To prevent unauthorized access to the interior of the dispenser, a key and latch mechanism 45 may be included to lock the front housing cover 25 to the back mounting plate 20. When the key and latch mechanism 45 is unlocked, the front housing cover 25 may pivot at hinge attachments 40 and swing downwards to allow access to the underside of the front housing cover 25 and the back mounting plate 20. The back mounting plate 20 may have one or more recesses or openings 50 that allow for a portion of the front housing cover 25 to pass through when in the open position so that it may be pivoted to a position that is approximately perpendicular to the back mounting plate 20.

Also shown in FIG. 1 is the dispenser outlet 60 on the bottomside 55 of the housing 15 and an activator member 65, such as a push button, disposed within the front housing cover 25. Consistent with the contoured and rounded design of the front housing cover 25, the activator member 65 may have sidewalls 66 that taper to a relatively smooth contact surface 68 with rounded edges. Thus, the activator member 65 is substantially devoid of ligature anchor points. Likewise, the dispenser outlet 60, which may be a separate component or integral to either the back mounting plate 20 or the front housing cover 25, also includes smooth outer walls 62 that are tapered to the outer edge 64. In a particular embodiment, the dispenser outlet 60 may be disposed within (e.g., machined in) a dispenser platform 70 that is attached or integral to the back mounting plate 20 and is substantially perpendicular to the back mounting plate 20 (see FIGS. 3A and 10B). It being understood that the term "substantially perpendicular" as used herein means at an angle between about 75 degrees and 105 degrees, preferably between about 80 degrees and 100 degrees, more preferably between about 85 degrees and 95 degrees, most preferably between about 88 and 92 degrees to a given surface. In a specific embodiment, when the front housing cover 25 is in the closed position, the dispensing platform 70 and the front housing cover 25 form an outer surface of the bottomside 55 that is substantially free of edges or gaps from which to anchor a ligature (see FIG. 9).

Figure 10A:
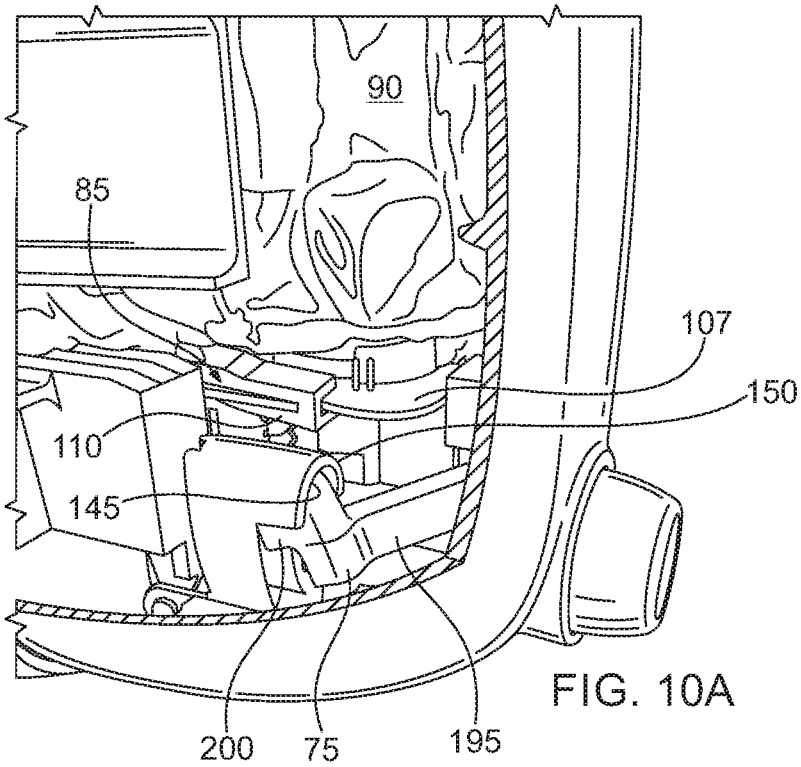
FIG. 10A is a front perspective view of an exemplary anti-ligature dispenser according to the concepts of the present disclosure. In this view, a section front housing cover is removed to provide a view of the interior of the exemplary dispenser.

The anti-ligature dispenser of the present disclosure may also include a dispensing system for the dispensing of a discrete amount of material, such as a liquid. The components of the dispensing system can be seen in FIGS. 2 and 3A and generally include an activator member 65, a lever member 75, an actuator 80, and a pump stabilizer 85 for receiving a container, such as a liquid container 90 and pump 95 assembly. In a particular embodiment, a container 90 that is filled with a liquid (e.g., soap or sanitizer) is inserted into the dispenser in an inverted orientation (see FIGS. 2A and 10). FIG. 4 provides a more detailed view of an exemplary container 90 that includes a pump 95 and a dispensing nozzle 100. The container 90 is stabilized within the housing by the pump stabilizer 85 as will be described in additional detail below. In this embodiment, the actuator 80 is vertically movable in relation to housing 15 and pump stabilizer 85 to cause mechanical actuation of the pump 95 resulting in dispensation of a discrete quantity of liquid from the dispensing nozzle 100, it being understood that pump 95 may be any liquid pump or a foam pump available in the art. In the example dispenser depicted in FIG. 2, the actuator 80 is movable in response to a force applied manually to the activator member 65, which acts upon the lever member 75 to move the actuator 80 against a pair of biasing springs 109. While this particular embodiment requires manual force to cause actuation of the pump 95, it is also contemplated that a sensor-motor type actuator system could also be used in the anti-ligature dispenser of the present disclosure.

Figure 5:
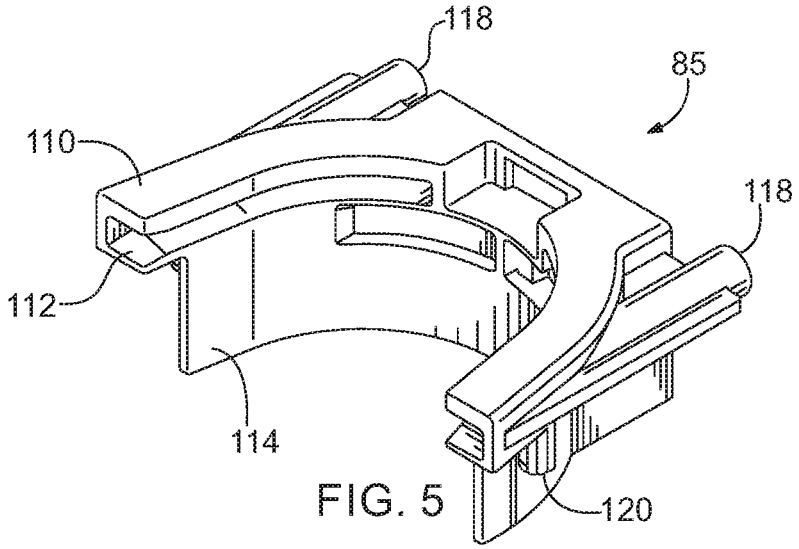
FIG. 5 is a front perspective view of an exemplary pump stabilizer component according to the concepts of the present disclosure.
Figure 6:
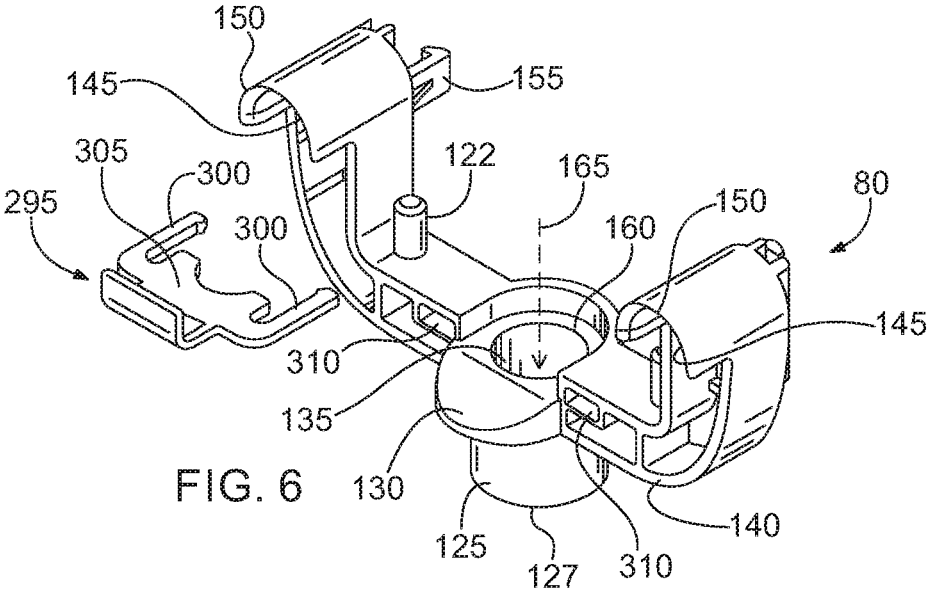
FIG. 6 is a front perspective view of an exemplary actuator component according to the concepts of the present disclosure.

The dispensing system of the anti-ligature dispenser 10 will now be explained in further detail. FIG. 5 illustrates an exemplary pump stabilizer 85 that includes a pump collar receptacle 110, a groove 112, a curved vertical wall 114, one or more fastening elements 118, and a spring pin 120. The pump stabilizer 85 may be fastened to the back mounting plate 20 by attaching the fastening elements 118 to an attachment point 118' on the back mounting plate 20 (see FIG. 3A). In other embodiments, the pump stabilizer 85 is integral to the back mounting plate 20 (e.g., machined into the back mounting plate). The biasing springs 109 connect the pump stabilizer 85 to the actuator 80 at spring pins 120 and 122, respectively (see FIGS. 5, 6, and 10B). The biasing springs 109 bias the actuator 80 to its rest position. Upon, application of force sufficient to overcome the biasing force of the biasing springs 109, the actuator 80 moves upwards in relation to the pump stabilizer 85 and into to its dispensing position (see FIG. 2). As shown in FIG. 6, the actuator 80 may include an inner dispensing cylinder 125 having a nozzle seat 160 at one end and an outer edge 127 at the other end. In this exemplary embodiment, the actuator 80 includes a pair of actuator arms 140 giving the actuator 80 a general u-shape. Each actuator arm 140 may include a notch 145 and a curved notch hood 150 at the distal end. Further, in this particular embodiment, each actuator arm 140 includes a guide tab 155. At its top portion, the inner dispensing cylinder 125 provides a nozzle ramp 130 as well as a nozzle receptacle 135 to provide a liquid flowthrough 165 for dispensed material. The inner dispensing cylinder 125 is slideably disposed within bore 170 of the dispensing outlet 60 (see FIGS. 2A and 3A). As the actuator 80 moves up and down within the housing 15, the inner dispensing cylinder 125 moves up and down within the dispensing outlet 60 and the guide tabs 155 move along guide flanges 175 that extend from the back mounting plate 20.

In some embodiments, a liquid or foam pump and refill container are used with the anti-ligature dispensers provided herein. The pump stabilizer 85 holds the pump in a position wherein the actuator 80 can cause dispensation of a discrete amount of liquid or foam from the container by actuating the pump. For instance, in an exemplary embodiment, container 90 is a disposable liquid refill container with a foam pump 95. The pump 95 includes a dispensing nozzle 100 that, when compressed into the body of the pump 95, causes a discrete amount of liquid or foam to be dispensed. In some embodiments, the dispensing nozzle 100 is comprised of two cylindrical portions; a wider cylindrical portion forming a nozzle shoulder 102 and a thinner cylindrical portion forming the nozzle tip 104 wherein the nozzle shoulder 102 and nozzle tip 104 are separated by an annular recess 106 (see FIG. 4). The pump 95 can be anchored into pump stabilizer 85 by way of a groove and tab fit. For instance, a pump collar 105, which is fitted around the circumference of the pump 95, may include a collar tab 107 that is slideably received into the groove 112 of the pump collar receptacle 110 (see FIGS. 5 and 10). As illustrated best in FIGS. 4, 6, and 10B, the dispensing nozzle 100 is slid over the nozzle ramp 130 of the actuator 80 so that the tip 104 of the dispensing nozzle 100 is inserted into the nozzle receptacle 135 of the inner dispensing cylinder 125. As noted above, the nozzle receptacle 135 of the inner dispensing cylinder 125 provides a liquid flowthrough 165 for the dispensing of the liquid or foam upon actuation of the pump 95.

Figure 2A:
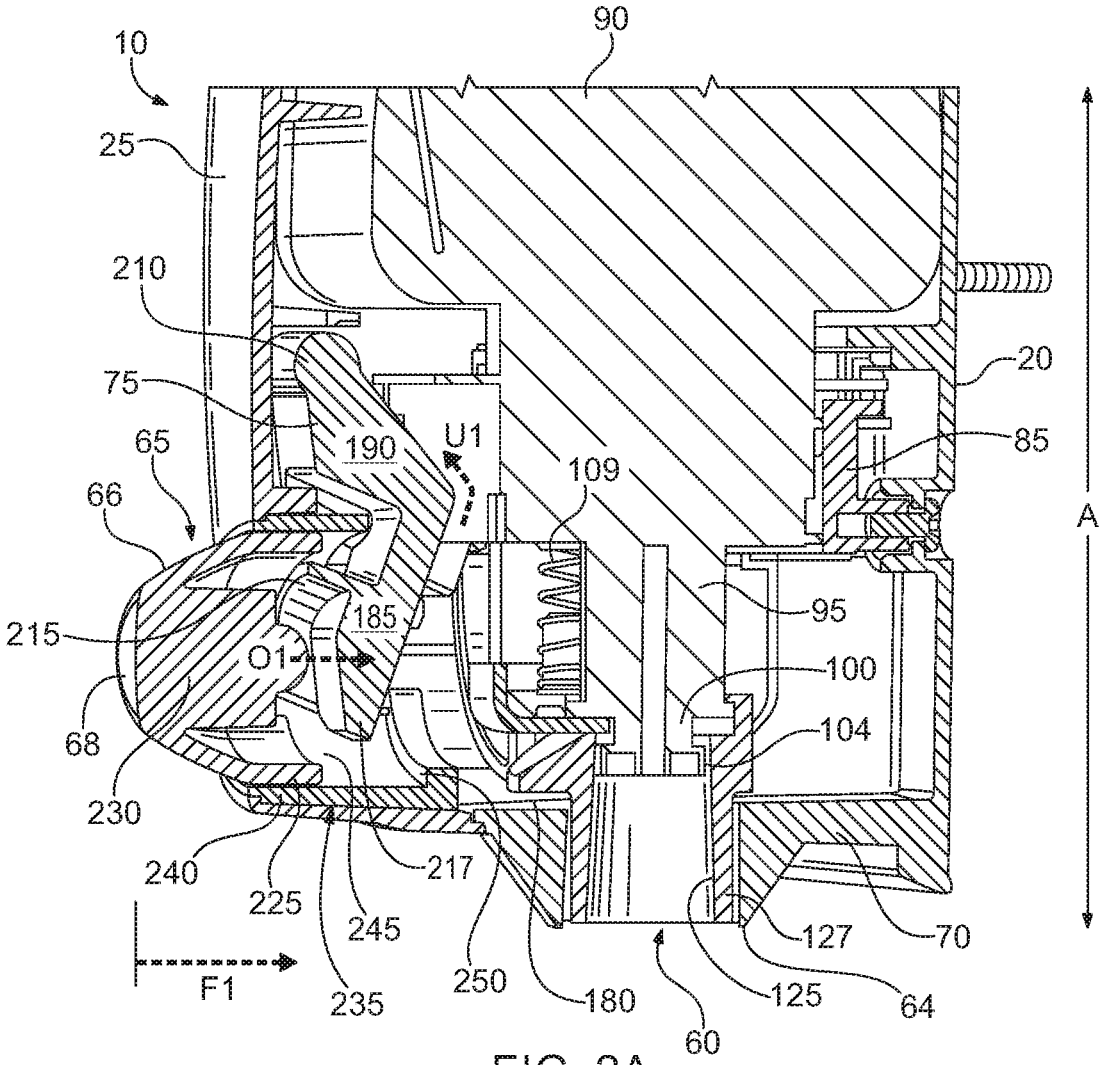
FIGS. 2A and B are diagrammatical representations of an an exemplary anti-ligature dispenser according to the concepts of the present disclosure.
Figure 2B:
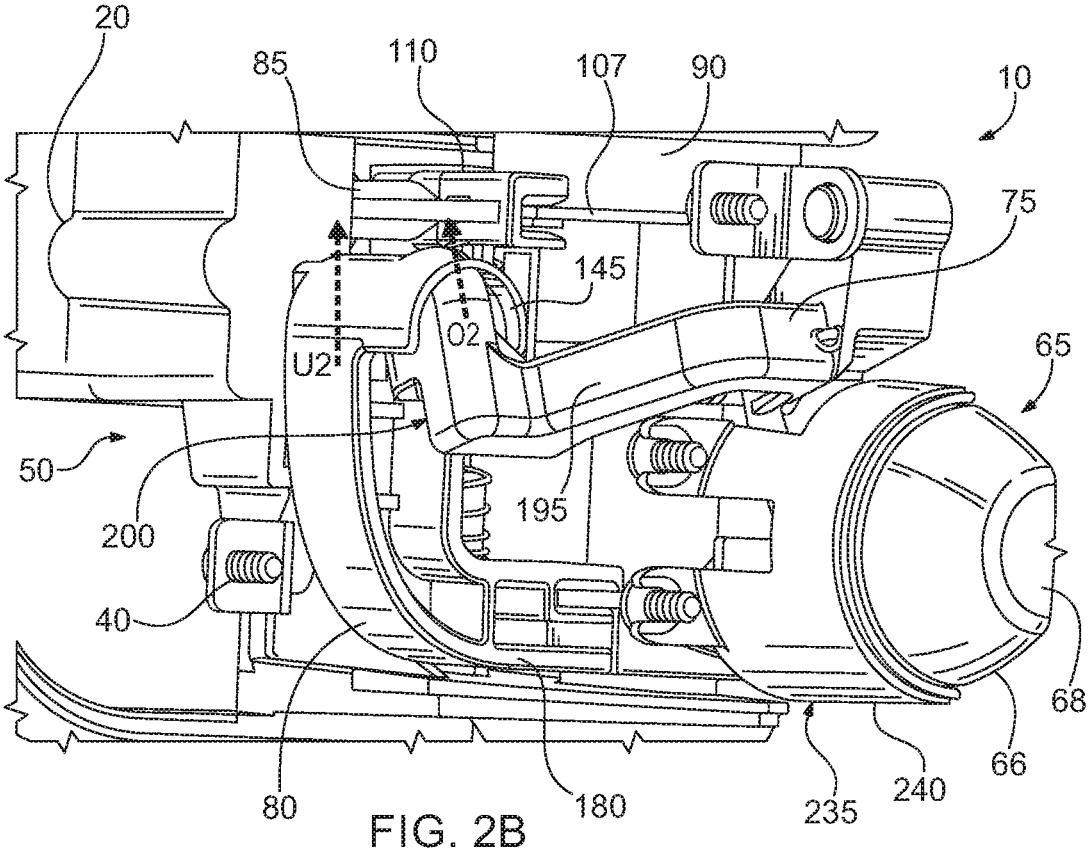
FIG. 2B is a front perspective view showing the interior of an exemplary anti-ligature dispenser.
Figure 3A:
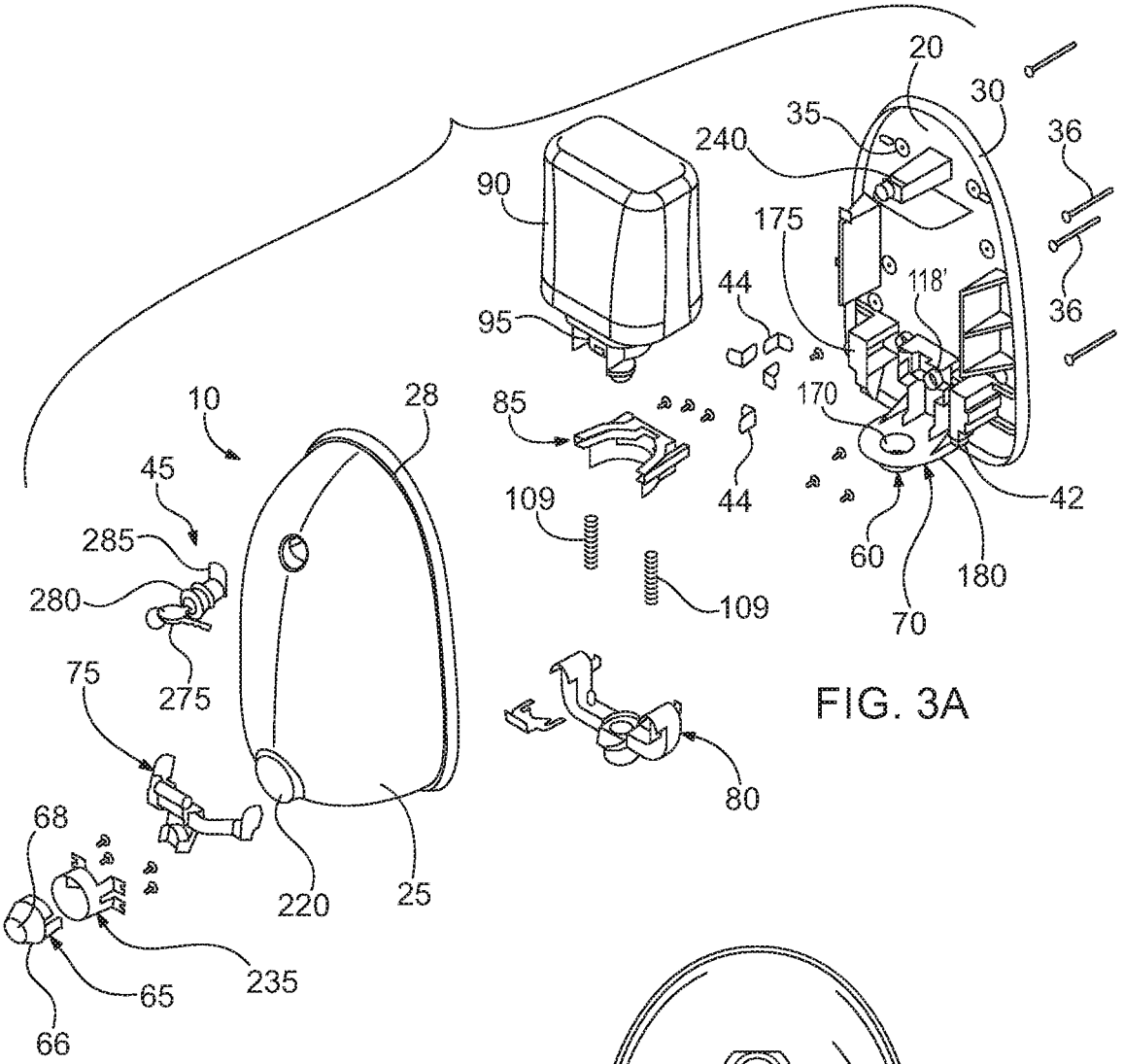
FIG. 3A is an exploded view of an exemplary anti-ligature dispenser according to the concepts of the present disclosure.
Figure 3B:
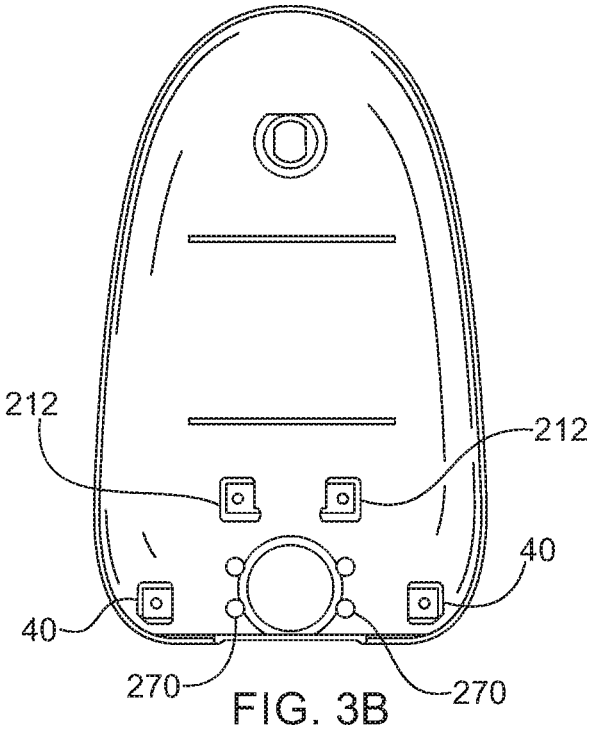
FIG. 3B is an interior view of an exemplary front housing cover according to the concepts of the present disclosure.
Figure 4:
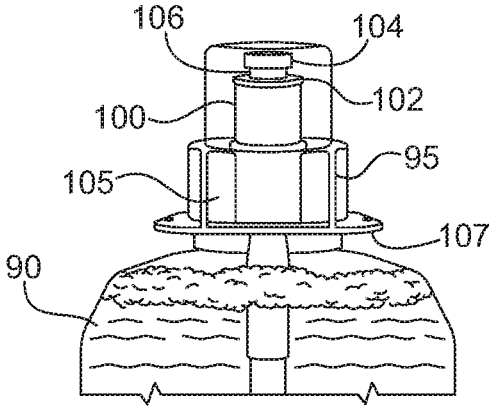
FIG. 4 is a side view of the top of an exemplary liquid container and pump according to the concepts of the present disclosure.
Figure 9:
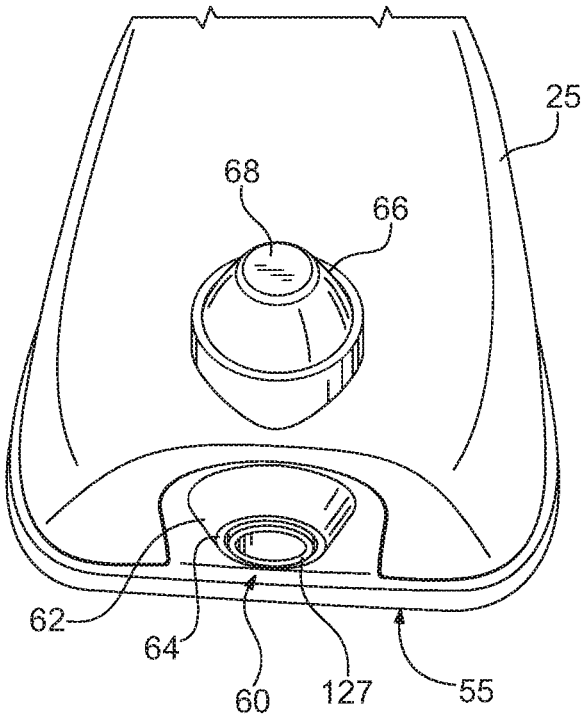
FIG. 9 is a bottom perspective view of an exemplary anti-ligature dispenser according to the concepts of the present disclosure.
Figure 10B:
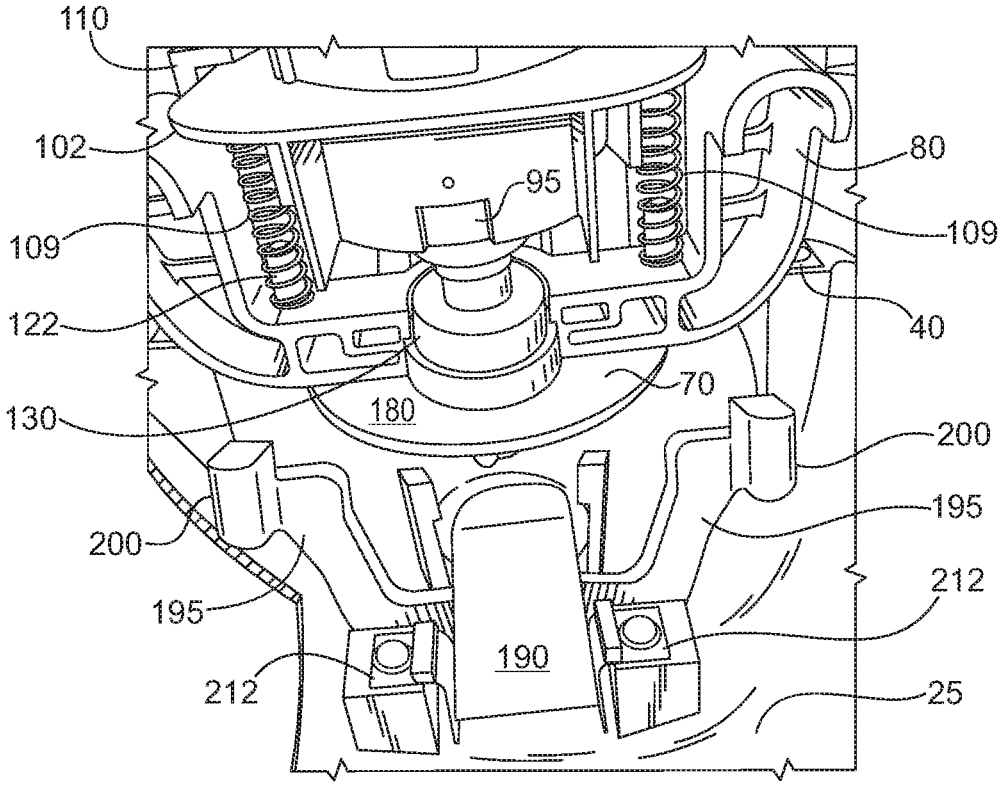
FIG. 10B is a front view of an exemplary anti-ligature dispenser according to the concepts of the present disclosure. In this view, the front housing cover is open to provide a view of the interior of the exemplary dispenser.

Prior to any force being applied to the system, the actuator 80 is in a rest position and seated on the dispensing platform via actuator seat 180 (see FIGS. 2A and 3A). When the actuator 80 is in this rest position, the outer edge 127 of the inner dispensing cylinder 125 is approximately flush with the outer edge 64 of the dispenser outlet opening 60 (see FIG. 9). In this configuration, there are no gaps, edges, or other points from which to anchor or attach a ligature. In some embodiments, the outer edge 127 of the inner dispensing cylinder 125 does not extend more than about 3 cm beyond the outer edge 64 of the dispenser outlet opening 60. In other embodiments, the outer edge 127 of the inner dispensing cylinder 125 does not extend more than about 2 cm beyond the outer edge 64 of the dispenser outlet opening 60. In other embodiments, the outer edge 127 of the inner dispensing cylinder 125 extends less than about 2.5 cm, e.g., about 2.4 cm, 2.3 cm, 2.2, cm, 2.1 cm, 2.0 cm, 1.9 cm, 1.8 cm, 1.7 cm, 1.6 cm, 1.5 cm, 1.5 cm, 1.4 cm, 1.3 cm, 1.2 cm, 1.1 cm, 1.0 cm, 0.9 cm, 0.8 cm, 0.7 cm, 0.6 cm, 0.5 cm, 0.4 cm, 0.3 cm, or 0.2 cm beyond the outer edge 64 of the dispenser outlet opening 60. Thus, as can be seen in FIG. 9, the cylinder-in-cylinder configuration is substantially devoid of ligature attachment points thereby providing an additional safety measure to the anti-ligature dispenser provided herein.

Figure 7A:
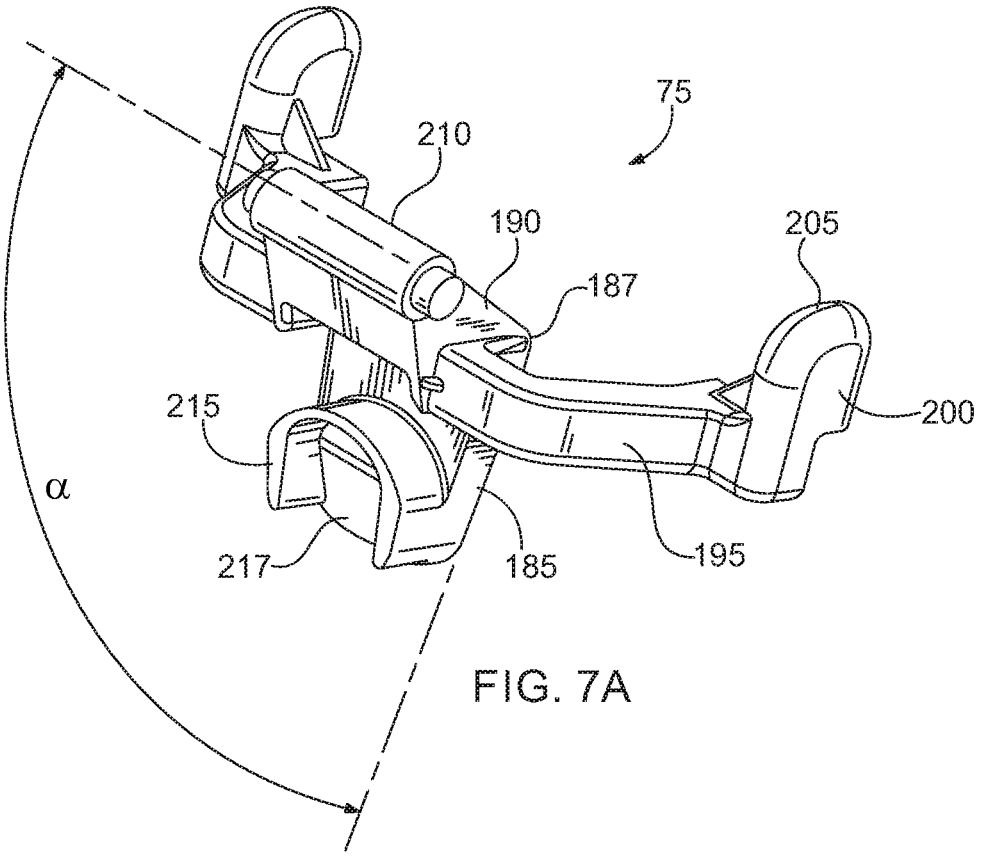
FIG. 7A is a front perspective view of an exemplary lever member component according to the concepts of the present disclosure.
Figure 7B:
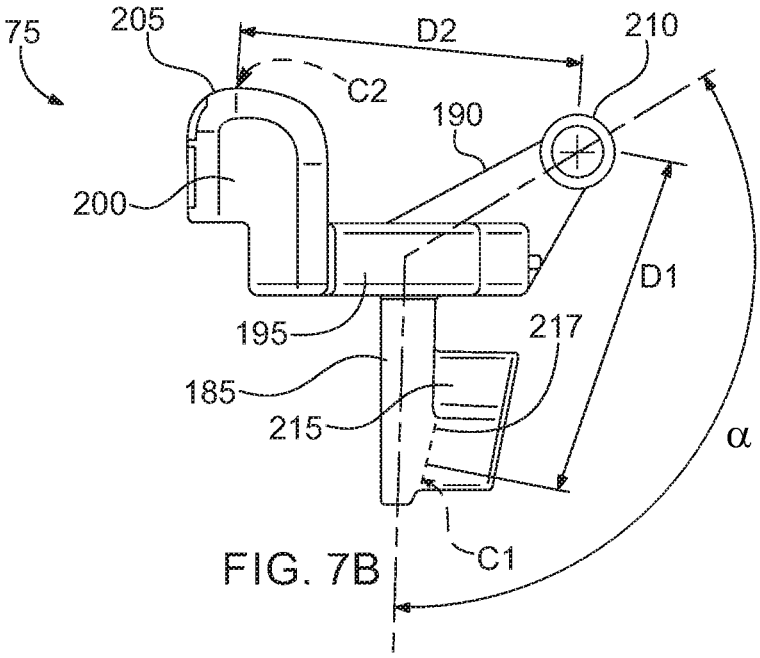
FIG. 7B is a side view of an exemplary lever member component according to the concepts of the present disclosure.

In operation, the actuator 80 is moved against biasing springs 109 and into its dispensing position where it can act upon the pump 95. In a particular embodiments, the dispensing system is activated by manual force applied to the activator member 65, which is translated to an upward movement by lever member 75 and application of an output force on the actuator 80 sufficient to overcome the biasing force of the biasing springs 109. As shown in FIGS. 7A and 7B, the lever member 75 may include a first lever section 185 that is connected to a second lever section 190 at a connection point 187. Further, the lever member 75 may include a pair of lever arms 195 that extend laterally from the second lever section 190. Each lever arm 195 may have a protrusion or head 200 that extends transversely or upwards from the distal end of the arm. Each arm protrusion or head 200 may have a generally rounded tip 205 that contacts the actuator 80 at a corresponding actuator notch 145 (see also FIGS. 2B and 10A). The lever member 75 may include a pivot 210 for attachment to the underside of the front housing cover 25 at a pivot attachment point 212 (see also FIGS. 2A and 3B). The pivot 210 allows for the lever member 75 to pivot upwards in response to force applied to the first lever section 185 or pivot downwards in response to force applied to the second lever member 190. The activator member 65 is disposed within an opening 220 in the front housing cover 25 (see FIG. 3A) and contacts the first lever section 185. For instance, as shown in FIG. 2A, the activation member 65 may include a lateral wall 225 that fits over a seat guide 215 on the lever member 75 and an inner plug 230 that contacts the activator seat 217.

As shown in FIG. 2, in a non-dispensing position, the biasing springs 109 bias the actuator 80 in a rest position where it contacts the actuator seat 180 on the dispensing platform 70. In operation, manual input force F1 is applied to the activator member 65 thereby depressing the activator member 65 into the opening 220 of the front housing cover 25. The inner plug 230 of the activator member 65 contacts the activator seat 217 of the first lever member 185. The activator member 65 provides an output force O1 to the first lever section 185 which causes lever member 75 to swing upwards U1 at the pivot 210. This movement, in turn, causes the second lever section 190 to apply an output force O2 and move the actuator 80 upwards U2 against the biasing springs 109 into its dispensing position. As the actuator 80 moves upwards, the nozzle seat 160 contacts the nozzle shoulder 102 of the dispensing nozzle 100 and compresses the dispensing nozzle 100 into the body of the pump 95 to cause dispensing of a discrete amount of liquid. The liquid then flows into the inner dispensing cylinder 125 of the actuator 80, through flowthrough 165, and out dispenser outlet 60. Once the manual input force F1 is removed, the biasing springs 109 move the actuator 80 back into its resting position. As the actuator moves downward, it causes the lever member 75 to pivot downwards thereby moving the activation member 75 back out through opening 220. The pump 95 is then recharged (i.e., the nozzle moves out of the body of the pump).

The dispensing system of the anti-ligature dispenser disclosed herein allows for efficient dispensing of foam or liquid while maintaining the anti-ligature design. As noted above, the activator member 65 has sidewalls 66 that taper to the contact surface 68. The smooth, contoured design of the activator member 65 is substantially devoid of ligature anchoring points. Further, the axis of the manual input force F1 applied to the activator member 65 is substantially perpendicular to a hypothetical vertical axis A of the dispenser 10 when mounted to a surface (see FIG. 2A). As a result, the activator member 65 moves into the housing in a relative horizontal direction, which is different from existing dispenser designs that utilize a lever mechanism that is accessible exteriorly to the housing and creates gaps for anchoring ligatures. Thus, contrary to these existing designs, there is no gap created between the activator member 65 and the housing 15 in the presently described anti-ligature dispensers. This is due, in part, because the lever member 75 of the present device is interior to the housing 15 and translates the horizontal force from the activator member 65 into a vertical movement and output force moving the actuator 80 upwards into the dispensing position.

Another benefit of the dispenser design provided herein is that it comprises the above-discussed anti-ligature features while maintaining adequate mechanical efficiency of the dispensing system, which is determined by the amount of input force needed to cause actuation and dispensing of an adequate amount of material (see, e.g., Example 1). The mechanical efficiency of this system may be further aided (i.e., by requiring less input force for adequate dispensing) by increasing the length of the first lever section 185 of lever member 75 as compared to the second lever section 190. For instance, as shown in FIG. 7B, the distance D1 is measured from point of initial contact C1 between the activator seat 217 and the inner plug 230 to the pivot 210. In particular embodiments, distance D1 is greater than the distance D2 that is measured from the pivot 210 to the point of contact C2 between the rounded tip 205 and the actuator notch 145. In some embodiments, distance D1 is at least 101% greater than distance D2, e.g., 101%, 102%, 103%, 104%, 105%, 106%, 107%, 108%, 109%, 110%, 111%, 112%, 113%, 114%, 115%, 116%, 117%, 118%, 119%, 120% greater than distance D2. In some embodiments, distance D1 is at least 105% greater than distance D2. In yet other embodiments, distance D1 is at least 110% greater than distance D2.

In addition, the lever angle of lever member 75 should be large enough to maintain the mechanical efficiency of the system. For instance, as shown in FIGS. 7A and 7B, the connection point 187 of the first lever section 185 and the pivot 210 of the second lever section 190 creates an angle $\alpha$ that is equal to or greater than about 90 degrees, e.g., 90 degrees, 91 degrees, 92 degrees, 93 degrees, 94 degrees, 95 degrees, 96 degrees, 97 degrees, 98 degrees, 99 degrees, 100 degrees, 101 degrees, 102 degrees, 103 degrees, 104 degrees, 105 degrees, 106 degrees, 107 degrees, 108 degrees, 109 degrees, 110 degrees, 111 degrees, 112 degrees, 113 degrees, 114 degrees, 115 degrees, 116 degrees, 117 degrees, 118 degrees, 119 degrees, 120 degrees, 121 degrees, 122 degrees, 123 degrees, 124 degrees, 125 degrees, 126 degrees, 127 degrees, 128 degrees, 129 degrees, 130 degrees, or more. In some embodiments, the angle $\alpha$ is in a range from about 100 degrees to about 130 degrees. In other embodiments, the angle $\alpha$ is in a range from about 110 degrees to about 120 degrees.

The anti-ligature dispensers provided herein may be used to dispense foam material, such as foam soap, from a refill container with a suitable foam pump system. Refill containers with foam pump systems are commercially available, e.g., the GOJO refill 5161 or 5162 (GOJO Industries, Inc., Akron, Ohio). In some embodiments, the inner dispensing cylinder 125 has a flowthrough diameter that is optimized for dispensing foam. In such embodiments, the diameter is between about 1.5 cm and about 3.0 cm, preferably between about 1.9 cm and about 2.8 cm, more preferably between about 2.0 cm and about 2.5 cm. In other embodiments, the flowthrough diameter is in a range of about 1.7 cm to about 2.3 cm or about 1.8 cm to about 2.2 cm. In yet other embodiments, the flowthrough diameter is about 1.9 cm. In other embodiments, the inner dispensing cylinder 125 has a flowthrough diameter that is optimized for liquid, such as liquid soap, and has a diameter between about 1.0 cm and about 3.0 cm.

Figure 8:
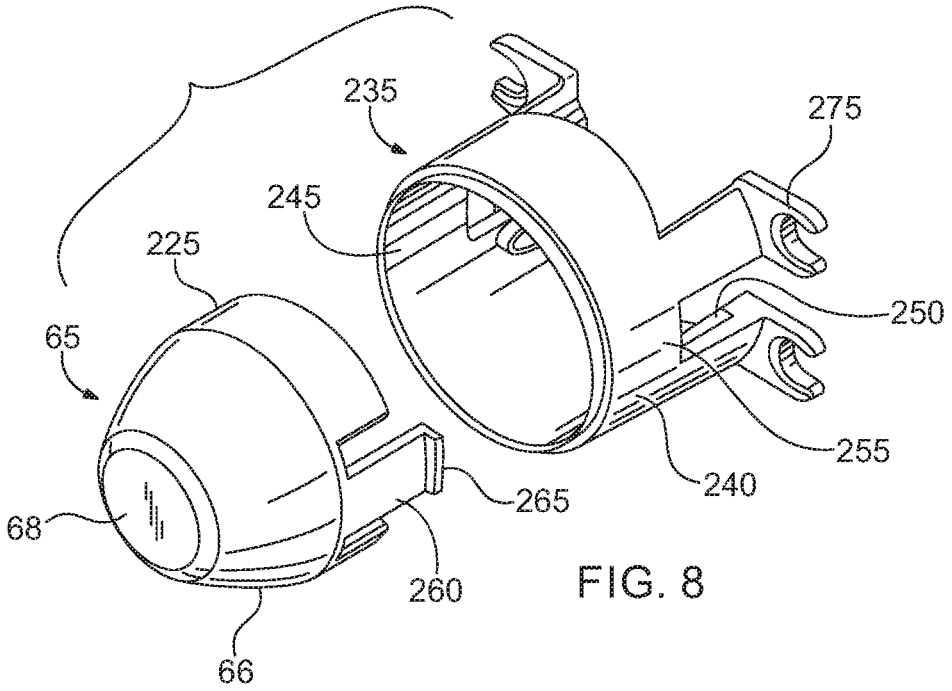
FIG. 8 is a front perspective view of exemplary activator member and activator guide cylinder components according to the concepts of the present disclosure.

The dispensing system of the anti-ligature dispenser may also include an activator guide cylinder 235. FIG. 8 depicts an exemplary activator guide cylinder 235 that may include a activator collar 240, a perimeter stop seat 250, and a stop tab lip seat 255. In devices that include an activator guide cylinder 235, the activator member 65 may additionally include a stop tab 260 with a lip 265 that protrudes outward from the distal end of the stop tab 260. The activator collar 240 slideably receives the lateral wall 225 of the activator member 65. The activator guide cylinder 235 may be disposed within opening 220 in the front housing cover 25 and attached to the underside of the housing at attachment points 270 via fasteners 275 (see FIG. 3B). As manual force is applied to the activator member 65, the lateral wall 225 moves along the inner wall 245 of the activator collar 240 until the manual force is removed or until the lateral wall 225 contacts the perimeter stop seat 250 of the activator guide cylinder 235. Once manual force is removed from the system, the biasing springs 109 move the actuator 80 downward from the dispensing position to the resting position, which, in turn, causes the lever member 75 to pivot back towards the opening 220 in the front housing cover 25. The activator member 65 then moves away from the perimeter stop seat 250 until manual force is again applied or the lip 265 of the stop tab 260 contacts the stop tab lip seat 255 of the activator guide cylinder 235.

Additional safety features may be added to some embodiments of the anti-ligature dispenser. Some embodiments may include a key and latch mechanism for preventing access to the interior. FIGS. 1A and 3A depict an exemplary locking mechanism 45 suitable for use with the anti-ligature dispensers disclosed herein. The locking mechanism 45 may be a standard tumbler locking mechanism wherein a key 275 is inserted into the keyhole 280 to rotate the latch 285 out of the latch receiver 290 so that the front housing cover 25 can be opened and swung down to expose the underside of the front housing cover 25 and interior of the back mounting plate 20. The locking mechanism 45 can be used to lock the front housing cover 25 in a closed position thereby preventing access to the interior of the dispenser.

Other embodiments include a security device that secures the dispensing nozzle of the pump to the actuator thereby preventing an individual from displacing the nozzle from the inner dispensing cylinder and accessing the interior of the dispenser housing. For instance, FIG. 6 depicts a security clip 295 that has a set of clip arms 300 for engaging a set of corresponding clip receptacles 310 in actuator 80. The security clip may have a tab or flange 305 sized to match a particular nozzle shape. An exemplary nozzle shape is depicted in FIG. 4 and shows pump 95 with dispensing nozzle 100 that includes a nozzle shoulder 102 and a disc-shaped nozzle tip 104 separated by an annular recess 106. When a container, such as container 90, is inserted into the dispenser, the nozzle tip 104 is positioned within the nozzle receptacle 135 of the actuator 80. The security clip 295 is then inserted into clip receptacles 310 in the actuator 80. The flange 305 of the security clip 295 fits within the annular recess 106 of the pump nozzle 100 thereby securing the nozzle tip 104 within the inner dispensing cylinder 125. In such a configuration, the nozzle 100 cannot easily be displaced from the inner dispensing cylinder 125 even when an individual inserts a finger or other object in the dispenser outlet 60.

The disclosure now being generally described, it will be more readily understood by reference to the following examples, which are included merely for purposes of illustration of certain aspects and embodiments of the present disclosure, and are not intended to limit the disclosure.

EXAMPLE 1

Mechanical Function Over Time

To test the mechanical functionality of the dispensing system over time, an anti-ligature dispenser as described herein was installed on a plywood wall. A soap container was installed into the dispenser and force-to-press was tested for 500 cycles. The amount of force needed to press the activator mechanism was measured at time 0 and after 500 cycles. Five measurements were taken for both time points. After 500 cycles, the average amount of force needed to press the button did not decrease significantly. There was no apparent damage, wear, or leakage to the unit. The unit was then tested for a life cycle of 100,000 cycles using a ¾ inch bore pneumatic cylinder tuned to smoothly push the activator member about once every second. The soap dispenser showed no signs of wear or degradation after 100,000 cycles and the amount of force needed to press the button did not decrease significantly.

EXAMPLE 2

Yield Strength

To test the force-to-yield of anti-ligature dispenser housing made from different materials, an impact study was carried out and analysis performed for aluminum alloy-1, aluminum alloy-2, and aluminum alloy-3. The loads were applied to simulate the impact forces applied to yield the front cover material. Linear analysis was performed using SOLIDWORKS Simulation Express (Dassault Systemes Solidworks Corporation, Waltham, Mass., USA). Due to software limitations, the model was over-constrained and run as a "fixed" constraint. Two load cases were used. Load case #1 tested a load applied directly to a 1.5 inch diameter area on the front and center of the front housing. Load case #2 tested a load applied directly to a 1.5 inch diameter area on the side of the front housing. The applied force required to yield the cover shape is shown in Table 1.

TABLE 1

Force-to-Yield of the Front Housing

| | Force-to-Yield (lbs.) | |
|---|---|---|
| | Load #1 | Load #2 |
| Aluminum alloy-1 | 340 | 1,300 |
| Aluminum alloy-2 | 575 | 2,300 |
| Aluminum alloy-3 | 450 | 1,800 |

The impact force required to yield the back mounting plate was also tested. In this load simulation, the simulation was run to determine the amount of force needed to bend the back mounting plate and create a gap between the back mounting plate and the mounting surface. The results are summarized in Table 2.

TABLE 2

Force-to-Yield of the Back Mounting Plate

| | Force-to-Yield (lbs.) |
|---|---|
| Aluminum alloy-1 | 100 |
| Aluminum alloy-2 | 170 |
| Aluminum alloy-3 | 140 |

All publications and patents mentioned herein are hereby incorporated by reference in their entirety as if each individual publication or patent was specifically and individually indicated to be incorporated by reference.

While specific embodiments of the subject disclosure have been discussed, the above specification is illustrative and not restrictive. Many variations of the disclosure will become apparent to those skilled in the art upon review of this specification and the claims below. The full scope of the disclosure should be determined by reference to the claims, along with their full scope of equivalents, and the specification, along with such variations.

What is claimed is:

1. A anti-ligature dispenser mountable to a surface comprising:

a back mounting plate having a vertical axis and adapted to be mounted to a surface, wherein the back mounting plate comprises a dispensing platform substantially perpendicular to the vertical axis of the back mounting plate, and wherein the back mounting plate further comprises a perimeter flange that extends outwardly from the back mounting plate;

a front housing cover having an underside, the front housing cover having a cover edge configured to abut the back mounting plate inside the perimeter flange thereby enclosing the back mounting plate when in a closed position and preventing access to the underside of the front housing cover; and a dispensing system configured to dispense a discrete quantity of fluid from a container, wherein the dispensing system comprises:

(i) a lever member having a pivot, a first lever section, and a second lever section, the pivot pivotally connected to the underside of the front housing cover so that the lever member is moveable between a first position and a second position upon application of an input force to the first lever section;

(ii) an actuator moving a pump of a liquid container between a rest and a dispense position and configured to contact at least one actuator contact point on the second lever section of the lever member; and (iii) an activator member comprising an exterior portion and an interior portion, wherein the exterior portion comprises a contact surface accessible on an exterior side of the front housing cover, and wherein the interior portion is configured to contact the first lever section of the lever member at an activator contact point;

wherein the dispensing platform comprises an inner surface and an outer surface;

wherein the front housing cover comprises a contoured outer surface substantially devoid of ligature anchoring points, wherein the front housing cover when in the closed position and the outer surface of the dispensing platform form a housing bottom underside that is substantially devoid of ligature anchoring points;

wherein the activator member is movable between a rest position and a dispense position; and wherein movement of the activator member between the rest position and the dispense position does not create gaps for insertion of ligatures between the activator member and the exterior side of the front housing cover.

2. The anti-ligature dispenser of claim 1, wherein the front housing cover is hingedly connected to said back mounting plate by at least one hinging mechanism, wherein the at least one hinging mechanism is disposed within the underside of the front housing cover.

3. The anti-ligature dispenser of claim 1, wherein the front housing cover comprises a material having a yield strength of at least about 100 MPa.

4. The anti-ligature dispenser of claim 3, wherein the front housing cover is made from aluminum metal.

5. The anti-ligature dispenser of claim 1, further comprising a first lever distance and a second lever distance, wherein the first lever distance is from the pivot to the activator contact point and the second lever distance is from the pivot to the at least one actuator contact point, and wherein the first lever distance is greater than the second lever distance;

wherein the activator member is configured to receive an application of an input force at an axis substantially perpendicular to the vertical axis of the back mounting plate and move from the rest position to the dispense position to apply a first output force to the first lever section of the lever member;

wherein the lever member, in response to the first output force, pivots from the first position to the second position and applies a second output force to the actuator; and wherein the actuator, in response to the second output force, moves from the rest position to the dispensing position along an axis that is substantially parallel to the vertical axis of the back mounting plate.

6. The anti-ligature dispenser of claim 5, wherein the first lever distance is 105% greater than the second lever distance.

7. The anti-ligature dispenser of claim 6, wherein the actuator comprises a set of upwardly curving actuator arms, the distal end of each actuator arm comprising an actuator notch; and wherein the lever member further comprises comprises a set of lever arms, each lever arm extending laterally from the second lever section, the distal end of each lever arm comprising an upwardly extending portion that is disposed within a corresponding actuator notch when the front housing cover is in the closed position.

8. The anti-ligature dispenser of claim 1, wherein the exterior portion of the activator member comprises tapered side walls that extend externally from the front housing cover to the contact surface, and wherein exterior portion and the contact surface of the activator member are substantially devoid of ligature anchoring points.

9. The anti-ligature dispenser of claim 1, wherein the actuator further comprises a first dispensing cylinder having a first outer edge and an opening for liquid flowthrough, wherein the opening has a diameter of between about 1.5 cm and about 2.5 cm.

10. The anti-ligature dispenser of claim 9, wherein the dispensing platform comprises a second dispensing cylinder having outer sidewalls tapered to a second outer edge and having an opening for receiving the first dispensing cylinder of the actuator, wherein the first dispensing cylinder moves within the second dispensing cylinder upon movement of the actuator between the rest position and the dispensing position, and wherein the first outer edge moves less than or equal to 1.5 cm externally to the second outer edge when the actuator is in the rest position.

11. The anti-ligature dispenser of claim 1, further comprising:

a pump stabilizing member connected to the back mounting plate and at least partially disposed within the underside of the front housing cover when in the closed position;

wherein the pump stabilizing member is configured to receive the pump of the liquid container; and wherein movement of the actuator to the dispensing position compresses the pump of the liquid container thereby dispensing fluid into the opening of the first dispensing cylinder.

12. A anti-ligature dispenser mountable to a surface comprising:

a back mounting plate having a vertical axis and adapted to be mounted to a surface, wherein the back mounting plate comprises a dispensing platform substantially perpendicular to the vertical axis of the back mounting plate;

a front housing cover having an underside, the front housing cover having a cover edge configured to abut the back mounting plate thereby enclosing the back mounting plate when in a closed position and preventing access to the underside of the front housing cover; and an actuator disposed within the underside of the front housing cover when in the closed position, the actuator moving a pump of a liquid container between a rest and a dispense position, wherein the actuator further comprises a first dispensing cylinder having a first outer edge and an opening for liquid flowthrough;

an activator member moveable between a first position and a second position, wherein the activator member comprises an exterior portion and an interior portion, wherein the exterior portion comprises a contact surface accessible on an exterior side of the front housing cover, and wherein movement of the activator member between the first position and the second position does not create gaps between the exterior portion of the activator member and the exterior side of the front housing cover;

wherein the dispensing platform comprises an outer surface and a second dispensing cylinder having outer sidewalls tapered to a second outer edge and having an opening for receiving the first dispensing cylinder, wherein the first dispensing cylinder moves within the second dispensing cylinder upon movement of the actuator, and wherein the first outer edge moves less than or equal to 1.5 cm externally to the second outer edge when the actuator is in the rest position; and wherein the front housing cover comprises a contoured outer surface substantially devoid of ligature anchoring points, and wherein the front housing cover when in the closed position and the outer surface of the dispensing platform form a housing bottom underside that is substantially devoid of ligature anchoring points.

13. The anti-ligature dispenser of claim 12, further comprising:

a lever member having a pivot, a first lever section, and a second lever section, the pivot pivotally connected to the underside of the front housing cover so that the lever member is moveable between a first position and a second position upon application of an input force to the first lever section, wherein the actuator is configured to provide at least one contact point with the second lever section of the lever member;

wherein the interior portion of the activator member is configured to contact the first lever section of the lever member; and wherein the activator member is configured to receive an application of an input force along a first axis and apply a first output force to the first lever section of the lever member, wherein the lever member, in response to the first output force, pivots from the first position to the second position and applies a second output force to the actuator, and wherein the actuator, in response to the second output force, moves from the rest position to the dispensing position along a second axis that is substantially perpendicular to the first axis.

14. The anti-ligature dispenser of claim 1, wherein the activator member is a push button.

15. The anti-ligature dispenser of claim 9, wherein the opening is configured for receiving a pump nozzle of the pump, wherein the actuator further comprises a clip receptacle configured for receiving a clip for attaching the pump nozzle to the actuator thereby preventing access to the interior of the housing.

16. The anti-ligature dispenser of claim 15, wherein the opening has a diameter of at least about 1.9 cm.

17. The anti-ligature dispenser of claim 1, wherein the front housing cover has an elongated dome shape.

* * * * *